US005829606A

United States Patent [19]

Erdmann

[11] Patent Number: 5,829,606

[45] Date of Patent: Nov. 3, 1998

[54] DEVICE FOR GUIDING A TELESCOPIC PART FOR A TELESCOPIC BOOM

[75] Inventor: Gerd Erdmann, Oldenburg, Germany

[73] Assignee: Kidde Industries, Inc., Iselin, N.J.

[21] Appl. No.: 812,940

[22] Filed: Mar. 4, 1997

[30] Foreign Application Priority Data

Mar. 4, 1996 [DE] Germany ..... 196 08 210.2

[51] Int. Cl.[6] ..... B66C 23/69

[52] U.S. Cl. ..... 212/350; 384/41; 384/42

[58] Field of Search ..... 212/348, 349, 212/350; 384/41, 42

[56] References Cited

U.S. PATENT DOCUMENTS

| | | | |
|---|---|---|---|
| 3,315,821 | 4/1967 | Grove | 212/349 |
| 3,338,642 | 8/1967 | Ortelli | 384/42 |
| 3,690,742 | 9/1972 | Sung | 384/42 |
| 3,719,404 | 3/1973 | Sterner . | |
| 4,016,688 | 4/1977 | Tiffin et al. | 212/350 |
| 4,148,531 | 4/1979 | Hornagold | 212/349 |
| 4,350,255 | 9/1982 | Blase et al. | 212/349 |
| 4,434,902 | 3/1984 | Goode et al. | 212/349 |
| 4,478,014 | 10/1984 | Poock et al. | 212/350 |
| 4,759,452 | 7/1988 | Faint et al. . | |
| 5,158,189 | 10/1992 | Watson et al. | 212/350 |

FOREIGN PATENT DOCUMENTS

| | | | |
|---|---|---|---|
| 0583552 | 2/1994 | European Pat. Off. . | |
| 2302644 | 11/1974 | Germany | 212/350 |
| 3042476 | 6/1982 | Germany | 212/349 |
| 3101017 | 8/1982 | Germany | 212/350 |
| 3508604 | 12/1991 | Germany . | |
| 3326108 | 12/1992 | Germany . | |
| 3546800 | 10/1994 | Germany . | |
| 213691 | 4/1924 | United Kingdom . | |
| 2136391 | 9/1984 | United Kingdom . | |

*Primary Examiner*—Thomas J. Brahan

[57] ABSTRACT

A boom collar for an outer telescopic boom section of a telescopic boom includes a tension belt forming at least a bottom surface and first and second curved corner portions of the collar. First and second sliders are disposed in the first and second curved corner portions, respectively, and the first and second sliders translate along the tension belt about a longitudinal axis of the said telescopic boom. First and second webs are connected to either side of the tension belt, and prevent the first and second sliders from moving in a direction of the longitudinal axis.

11 Claims, 4 Drawing Sheets

DEVICE FOR GUIDING A TELESCOPIC PART FOR A TELESCOPIC BOOM

The invention relates to a device for guiding an inner telescopic part at the shaft area, inside an outer telescopic part of a telescopic boom for a crane or the like.

BACKGROUND OF THE INVENTION

The telescopic parts or sections for telescopic booms of cranes, e.g. mobile or vehicle cranes, are guided at the shaft and the base areas. While satisfactory solutions are available for guiding the telescopic boom sections or parts at the base area, a variety of solutions are known for guiding the parts at the shaft area, cf. eg. GB-A-2 136 391, U.S. Pat. No. 5,158,189, EP-A-0 583 552, U.S. Pat. No. 4,759,452, DE-C-33 26 108, GB-PS 213,691, DE-C-35 46 800, DE-C-35 08 604, DE-C-33 26 108, U.S. Pat. No. 4,759,452 and U.S. Pat. No. 5,158,198, which, however, do not meet all requirements for guiding such telescopic parts at the shaft area.

The guideways at the shaft area determine the position of the telescopic parts, and they must be adjustable and also variable. The wear acting on the wear pads or sliders should be kept to a minimum and the steel construction should be subjected to no wear at all.

Therefore, sliders or wear pads made of a special plastic material, in particular of polyamide 6 and various additives, such as for example graphite, are used as a rule. Other materials with good gliding characteristics, however, can be considered as well.

In order to compensate for manufacturing tolerances and to achieve a guidance subjecting the structure to a minimum of wear, most guideways are capable of adapting to the prevailing conditions, to which end the sliders are supported movably in the collar area on the outer end of a boom section.

A corresponding structure as acknowledged in the opening clause can be gathered from U.S. Pat. No. 3,719,404 which, for instance, uses spherical seat castings or corresponding welded structures, which are provided with the plastic sliders.

These plastic sliders are supported inside the collar of the outer telescopic part along associated axes. As a result, however, forces are introduced into the collar at two points only so that the area at which the forces are introduced into the collar always has to be designed with a massive structure. This design causes high manufacturing costs and, additionally, great weight.

Therefore, the object of the invention is to provide a device for guiding an inner telescopic part at the shaft area inside an outer telescopic part of a telescopic boom of a crane of the indicated kind which does not exhibit the disadvantages mentioned above. In particular, the invention intends to suggest a boom guidance assembly in the collar area which meets all strength, support, etc., requirements, is less expensive to manufacture, and has a lighter weight structure.

SUMMARY OF THE INVENTION

The advantages achieved by the invention are based on a novel collar design and the thus resulting optimal introduction of forces into the collar area of the outer telescopic part by means of the sliders and a tension belt. The forces occurring at the sliders or wear pads act on the tension belt and are introduced into the collar of the outer telescopic part by the tension belt over a large area. Therefore, it is no longer necessary to provide the force introduction area of the collar with extensive and expensive reinforcements, as has been the case to date when the forces are only introduced into the collar at two exactly defined points.

Thus, the forces exerted by the inner telescopic part are introduced into the collar area of the outer telescopic part directly by means of the sliders and the tension belt due to which complex and expensive welded structures or shaped castings, which have been used to date in the art, are no longer required.

Also, the collar need not be machined any more in order to provide the support points required so far. The position of the inner telescopic part can be varied by varying the heights of the sliders without requiring an adjustment of the support.

According to a preferred embodiment the sliders are arranged on the usually provided lower radial surfaces of the collar so that the forces are introduced into the tension belt and thus into the collar in an exactly symmetrical manner.

It is suitable to adapt the shape of the sliders to the shape of the space between the inner telescopic part or boom sections and the outer telescopic part or boom section, so that the sliders are held on the lower radial surfaces of the collar in a form-locking manner.

Although in principle the radial surfaces may have other shapes as well, according to a preferred embodiment the lower radial surfaces of the collar, on which the sliders are disposed, are shaped approximately like on one or also several circular arcs as a result of which the outer radial curvature of the sliders or wear pads has a corresponding shape. This allows a certain balance by sliding the sliders on the radial surfaces in the collar area in case any forces act upon the structure and, additionally, the occurring forces can be introduced into the tension belt uniformly over a relatively large area.

It is suitable to design the inner radial surfaces of the sliders on which the inner telescopic part rests as a plane surface in order to keep the friction between the sliders and the inner telescopic part to a minimum.

In most applications it should be sufficient that the tension belt is only approximately U-shaped and only extends along the bottom and the two lower halfs of the collar side areas, as in order to achieve its purpose it is only important that, as already explained above, the occurring forces are introduced into the collar over a large area via the sliders and the tension belt. For reasons of manufacturing and production efficiency, however, the tension belt usually is designed to have a closed shape so that it extends across the entire inner surface of the collar, that is, including the top portion of the collar.

According to a preferred embodiment the tension belt is fixed to the collar by welding it to the collar.

Furthermore, when the tension belt has a closed shape, whereby it extends around the entire inner surface of the collar, the contact areas of the tension belt are welded together.

According to a preferred embodiment the tension belt consists of a steel elastic material, in particular a high-strength fine-grained steel, ensuring both the required high strength and the desired elasticity in the collar.

The sliders on each radial surface of the collar can be designed to consists of one or several parts. The only important point is that the overall shape of each slider, i.e., the overall shape of a slider consisting of several parts as well, is adapted to the spatial conditions.

According to a particularly suitable embodiment of the invention the collar is provided with a projection both at its front end and at its rear end, when viewing the ends in the telescopic direction of the telescopic boom, so that the tension belt as well as the sliders can be fixed between these projection areas and thus in the plane of the collar without requiring any further fixing or connecting elements.

Hereinafter, following the invention will be explained in greater detail by means of embodiments and with reference to the attached schematic drawings.

DESCRIPTION OF THE PREFERRED EMBODIMENT

Figure 1:
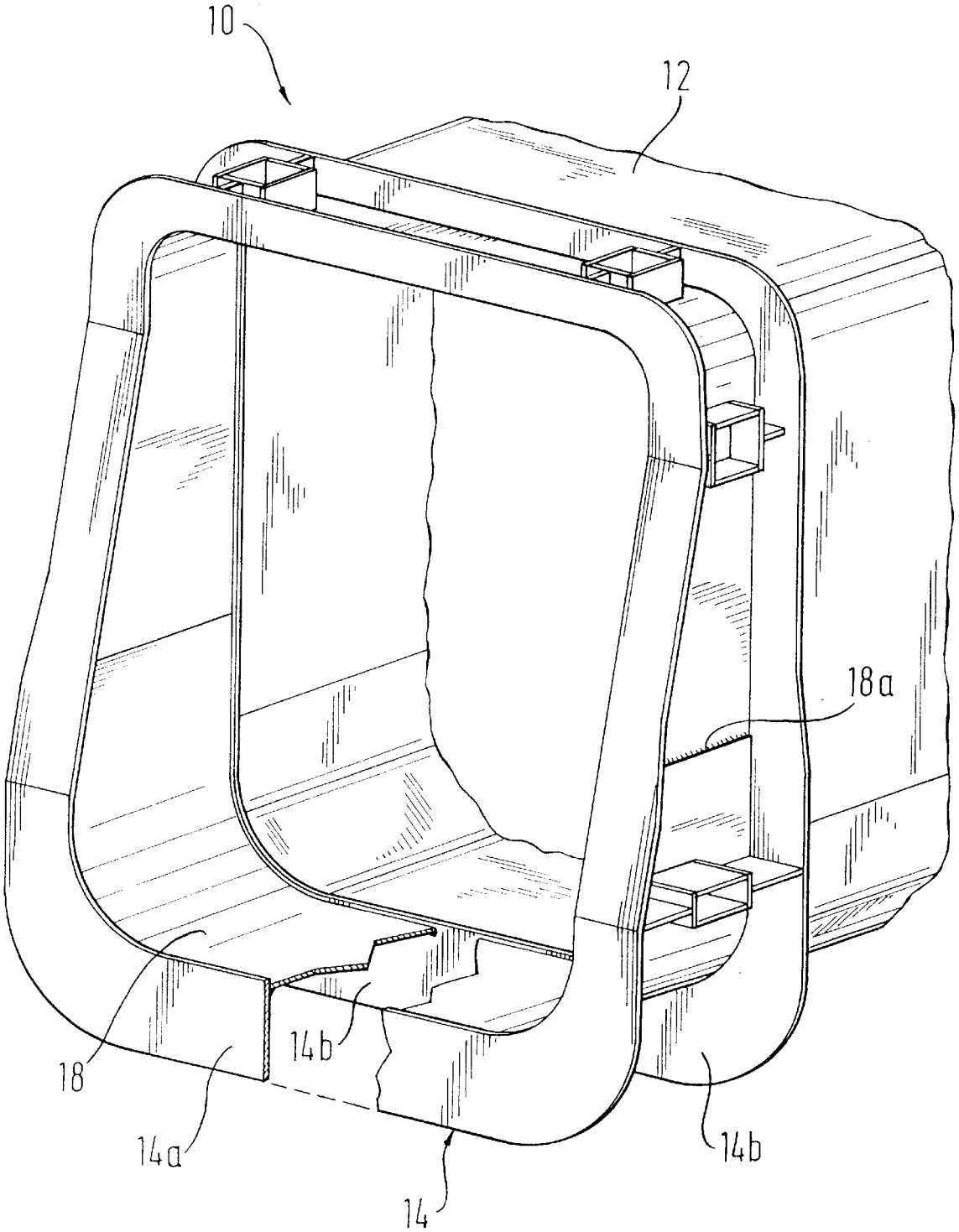
FIG. 1 is a perspective view, partly broken away, of the front area of an outer telescopic part of a telescopic boom with the collar and the tension belt of the invention, but without the sliders.

FIG. 1 show a perspective view of a boom collar 10 and more particularly of a fragmentary portion of the front portion of an outer telescopic part 12 of a telescopic boom for a mobile or vehicle crane. This outer telescopic part 12 has the usual hexagonal cross-section shape at the outside, comprising an approximately rectangular corner both on the upper right and upper left sides and, at each side of the bottom, two corners having an angle of approximately 45° so that the angles of the comers sum up to 90° in total.

Figure 3:
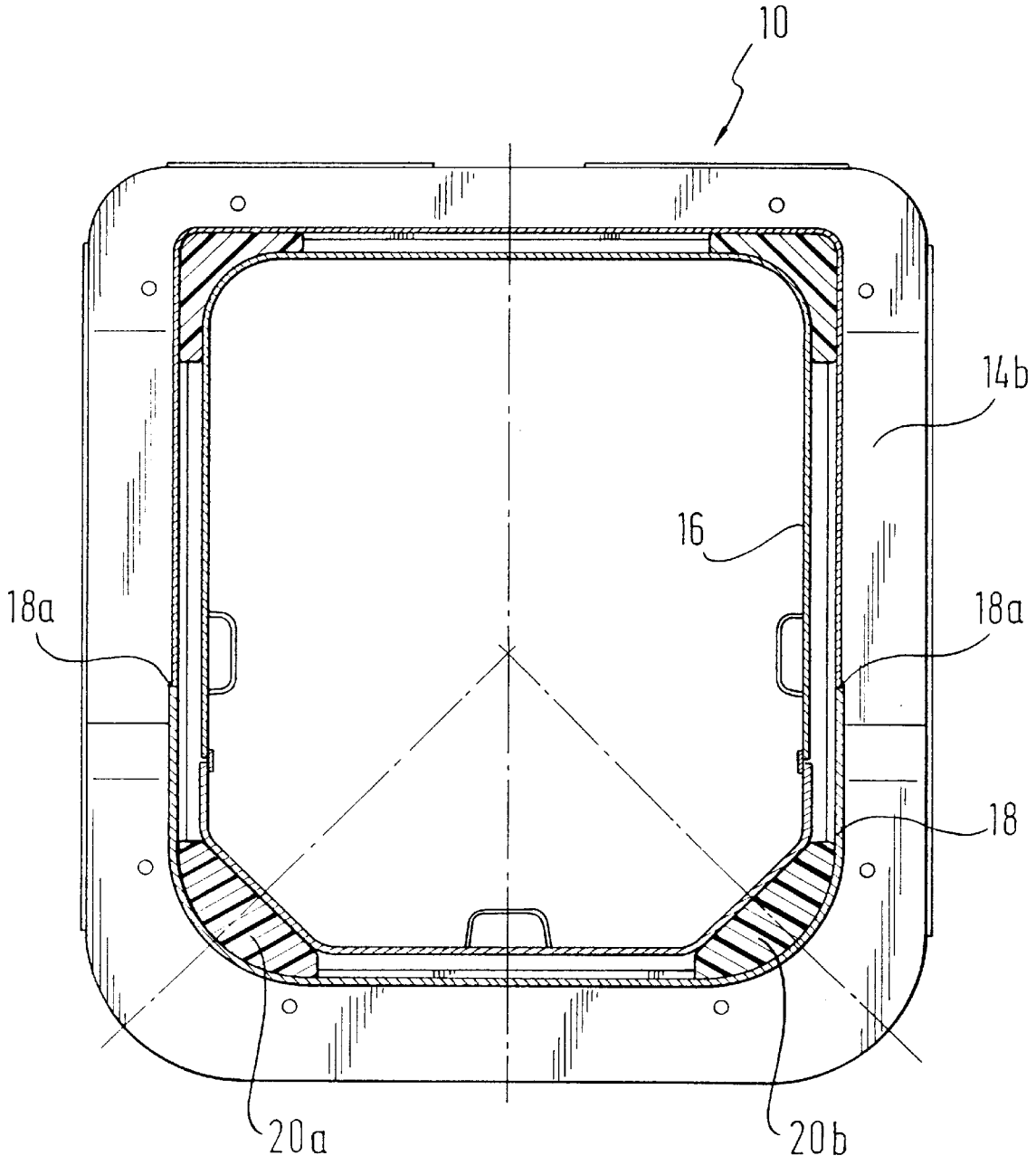
FIG. 3 is a vertical cross-section view through the guidance area of, and between the two webs of the collar of the telescopic boom according to the invention, and showing an inner telescoping boom section.

The end of the outer telescopic part 12, which constitutes the front or outer end of the telescopic part or boom section, when viewed in the direction of the telescoping movement, is provided with a collar 10 welded thereto, the shape of which corresponds approximately to the shape of the outer telescopic part 12, as can be seen from FIG. 3. In this view the two curvatures of the lower corners are shaped approximately like a quarter circle. This basic shape of the collar 10 is provided with webs 14*a* and 14*b* at the front and rear ends, respectively, spaced apart by connecting members welded therebetween.

Inside the collar 10 a tension belt 18 made of a high-strength fine-grained steel is provided, which extends betewen the two webs 14*a*, 14*b* across the entire inner surface of a collar 10 and is welded to the inwardly facing surface of webs 14*a* and 14*b* of the collar 10, as shown in FIG. 1, along the entire circumference of the collar 10. In order to distribute the forces more evenly over the circumference of the collar 10, the opposite eges of the tension belt 18 are welded to the adjacent webs 14*a* and 14*b*, throughout their lengths, by individual spot welds, welds over short stretches or continuous welds along the entire length of the belt edges. In a modified structure only one edge of the tension belt 18 is welded to either web 14*a* or web 14*b*. In FIG. 3, reference numeral 18*a*, indicates a possible joining area of the tension belt 18. It is to be understood that tension belt 18 is constructed of a different type of steel than the steel of which telescopic boom section 12 is constructed.

The wear pads on sliders 20*a*, 20*b* are arranged symmetrically at the bottom of the collar 10, on opposite sides of the longitudinal axis of the collar and the telescopic boom. In the two lower curvatures of the collar 10, which are shaped approximately as quarter circles, sliders or wear pads 20*a* and 20*b*, made preferably of polyamide 6 including graphite additives, are arranged, the outer surfaces of which correspond in shape to the above mentioned quarter circle shapes, and the inner surfaces of which are planar, as can be seen in FIG. 3.

An inner telescopic part or boom section 16 is provided with straight corner surfaces at its two lower corner edges, and these straight corner surfaces extend the length of the inner telescopic boom sections 16. The straight corner surfaces rest on the planar inner surfaces of the sliders 20*a* and 20*b*, and are in sliding engagement therewith.

Figure 2:
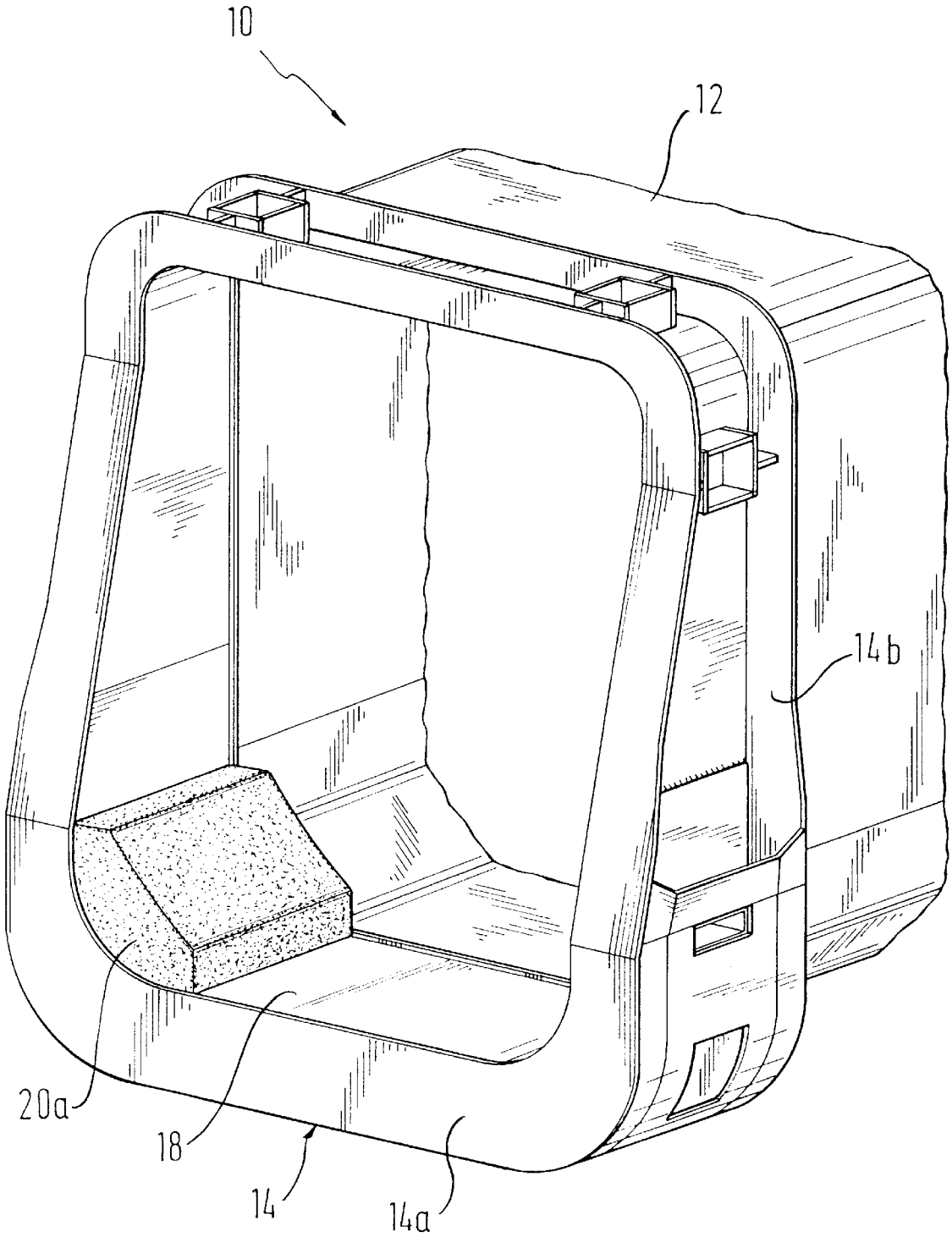
FIG. 2 is a perspective view corresponding to FIG. 1 including a slider on the lower left-hand curvature of the collar, the lower right-hand slider being omitted for clarity.

In a view corresponding to FIG. 1, FIG. 2 shows the collar 10 with the slider 20*a* positioned on its inner curvature on the lower left-hand side, but does not show the slider 20*b* disposed on its inner curvature on the lower right-hand side for purpose of clarity, since this is shown in FIG. 3.

The sliders 20*a* and 20*b* are held and retained at their front and rear ends by the webs or projections 14*a* and 14*b* of the collar 10, and by the tension belt 18 at their radial curvature portion. The sliders thus removably sit on the tension belt 18, and are retained in position by the webs on the collar, and the mating sliding surfaces of the inner telescopic boom section 16.

When the inner telescopic part 16 is extended the planar corner surfaces at the lower side of the inner telescopic part 16 slide on the inner planar surfaces of the sliders 20*a* and 20*b*, resulting in a very accurate guidance of telescopic part 16 with very low friction.

The forces generated by the inner telescopic part 16 during the extension and retraction thereof, are introduced into the tension belt 18 via the sliders 20*a* and 20*b*, and, via this tension belt 18, are introduced into the collar 10 over a large area resulting in a very favorable distribution of the forces. If the load is not distributed uniformly the outer radius of the sliders 20*a*, 20*b* permits a load balance by sliding the sliders 20*a*, 20*b* slightly transversely on the radial curvatures of the collar 10, as viewed in FIGS. 3 and 4. allowing tolerance adaptation.

To achieve this purpose it is important also that on the one hand the sliders 20*a*, 20*b* are positioned freely and movably in the plane of the collar on the lower radial surfaces of the collar 10 and thus of the tension belt 18, so that they can slide slightly and, on the other hand, are held by the projections 14*a* and 14*b* of the collar 10, and the sliding force generated by the supported inner telescopic part 16.

While FIGS. 1, 2 and 3 show a preferred embodiment in which the tension belt 18 extends across and comprises the entire inner surface of the collar 10, an alternative embodiment is possible as well in which the tension belt 18 extends only approximately up to the middle of the height of the collar, i.e. approximately up to the joining area 18*a* shown in FIG. 3 without impairing its function. In principle in some cases it is sufficient to dispose the tension belt 18 only on the bottom horizontal portion 14 of collar 10. In such case the opposite horizontal edges of tension belt 18 are welded between and to the upper portions of the lower horizontal portions of webs 14*a* and 14*b* so that the forces are essentially transmitted from the tension belt into the upper portion of the horizontal bottom 14 of collar 10.

Finally, in an embodiment differing from the embodiment shown above, the sliders 20*a*, 20*b* may also consist of several individual parts, the overall shape of which, however, corresponds to the shape shown for instance in FIG. 2.

Figure 4:
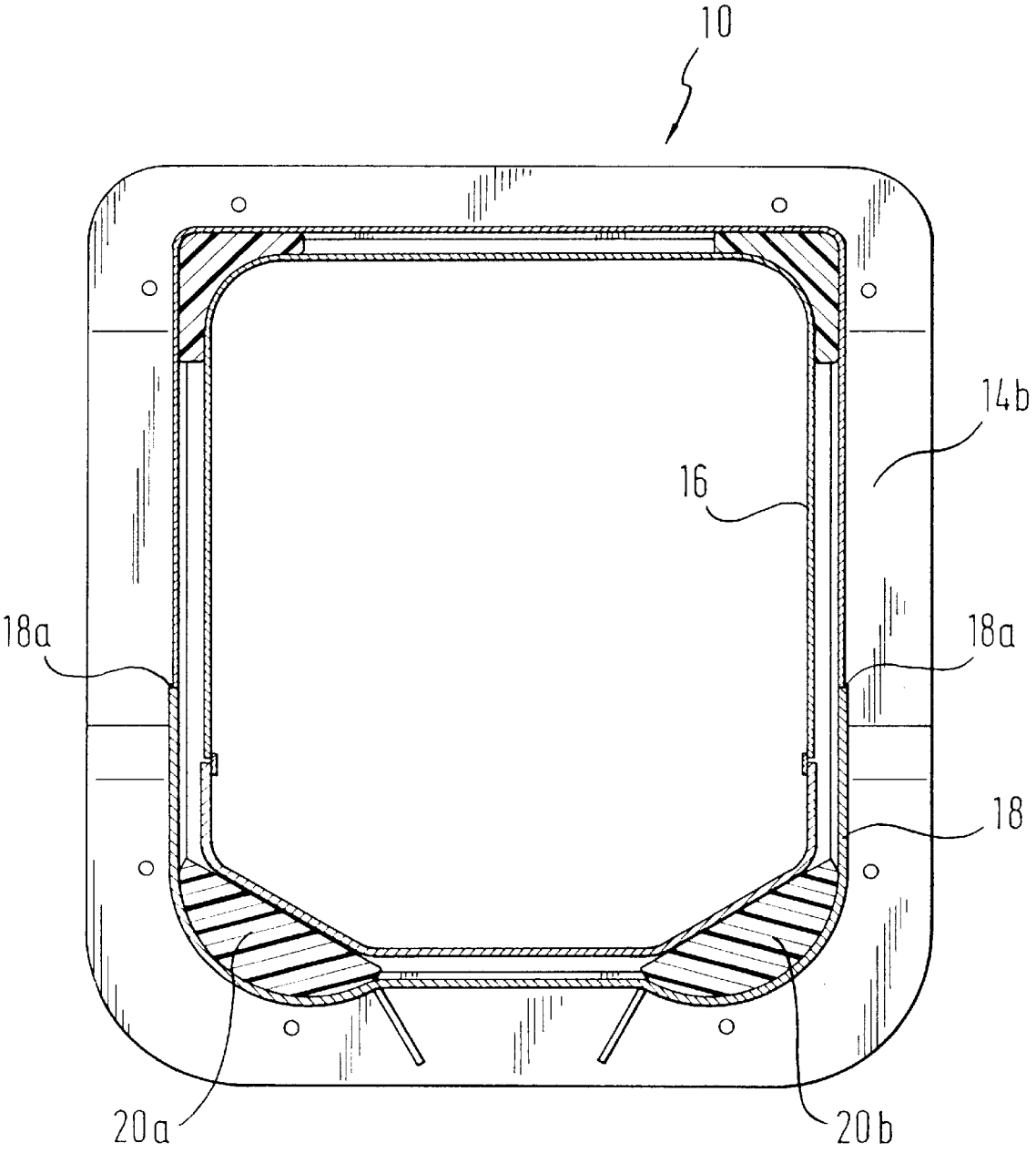
FIG. 4 is a view similar to FIG. 3 of a modified embodiment of the invention for a different boom section.

In a view corresponding to FIG. 3, FIG. 4 shows a section through a point at the front of the telescopic boom at which only an inner telescopic part 16 and an outer telescopic part with a collar 10 are disposed, i.e., at which no other inner telescopic parts and drive means can be recognized.

Finally, in a view corresponding to FIG. 3, FIG. 4 shows lower radial curvatures in the collar 10 having a slightly different shape, which, after forming a quarter circle shape, extended somewhat further upward, i.e., form a circular arc of approximately 110°, upstream of the ensuing horizontal lower bottom area of the collar 10, which is due to the fact that the corners of the inner telescopic part 16 have different angles.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. A boom collar for an outer telescopic boom section of a telescopic boom, comprising:

a tension belt forming at least a bottom surface and first and second curved corner portions of said collar;

first and second sliders disposed in said first and second curved corner portions, respectively, said first and second sliders translating along said tension belt about a longitudinal axis of said telescopic boom; and first and second webs connected to either side of said tension belt, and preventing said first and second sliders from moving in a direction of said longitudinal axis.

2. The boom collar of claim 1, wherein said first slider is in contact with said first curved corner portion and an inner telescopic boom section of said telescopic boom such that said first slider is held in a form-locking manner; and said second slider is in contact with said second curved corner portion and said inner telescopic boom section such that said second slider is held in a form-locking manner.

3. The boom collar of claim 1, wherein said first slider has a first and second surface, said first surface conforms to a shape of said first curved portion and said second surface conforms to a shape of a portion of an inner telescopic boom section of said telescopic boom in contact with said second surface; and said second slider has a third and fourth surface, said third surface conforms to a shape of said second curved portion and said fourth surface conforms to a shape of a portion of said inner telescopic boom section in contact with said fourth surface.

4. The boom collar of claim 3, wherein said second and fourth surfaces are planar.

5. The boom collar of claim 1, wherein said first and second curved portions are shaped like circle segments; and said first and second sliders have surfaces shaped like a circle segment in contact with said first and second curved portions, respectively.

6. The boom collar of claim 5, wherein said first and second curved portions are shaped like quarter circle segments.

7. The boom collar of claim 1, wherein said tension belt has a U-shape.

8. The boom collar of claim 1, wherein said tension belt is made of an elastic steel material.

9. The boom collar of claim 1, wherein said tension belt is made of a high-strength fine-grained steel.

10. The boom collar of claim 1, wherein said first and second sliders are made of polyamide 6 including graphite additives.

11. The boom collar of claim 1, wherein said first slider is an integral piece; and said second slider is an integral piece.

* * * * *